United States Patent [19]

Eickmann

[11] 4,212,230

[45] Jul. 15, 1980

[54] SLIDE FACES OF PISTON SHOES IN RADIAL PISTON MACHINES

[76] Inventor: Karl Eickmann, 2420 Isshiki, Hayama-machi, Kanagawa-ken, Japan

[21] Appl. No.: 822,161

[22] Filed: Aug. 5, 1977

Related U.S. Application Data

[63] Continuation-in-part of Ser. No. 537,352, Jan. 10, 1975, abandoned, which is a continuation-in-part of Ser. No. 477,085, Jun. 6, 1974, Pat. No. 3,951,047.

[51] Int. Cl.[2] ..... F01B 13/06

[52] U.S. Cl. ..... 92/58; 91/488; 92/72; 92/148; 92/159

[58] Field of Search ..... 92/12.1, 58, 72, 148, 92/157, 159; 91/488, 491

[56] References Cited

U.S. PATENT DOCUMENTS

| | | | |
|---|---|---|---|
| 3,223,046 | 12/1965 | Eickmann | 92/58 |
| 3,255,706 | 6/1966 | Eickmann | 92/58 |
| 3,277,834 | 10/1966 | Eickmann | 92/58 |
| 3,304,883 | 2/1967 | Eickmann | 92/58 |
| 3,628,425 | 12/1971 | Morita | 91/488 |
| 3,650,180 | 3/1972 | Gantschnigg | 91/488 |
| 3,828,657 | 8/1974 | Neuman | 91/488 |
| 3,945,303 | 3/1976 | Steiger | 92/58 |
| 3,948,149 | 4/1976 | Fricke | 91/488 |

*Primary Examiner*—Abraham Hershkovitz

[57] ABSTRACT

Piston shoes in radial piston devices of the prior art were provided with balancing fluid pressure pockets of circular configuration or of elongation normal to the movement direction of the piston shoes. Piston shoes had to provide the space for said pockets and thereby extended over the diameter of the piston. That resulted in deformation of the piston shoe and in friction in areas that cannot be lubricated between the piston shoe outer face and the piston actuator guide face. The invention provides a pair of balancing pockets normal to that of the prior art and extended in the movement direction of the piston shoes. Piston shoes are therefore short in the direction of the pivot axis, deformations are prevented and the areas that cannot be lubricated are reduced to a minimum or removed. The piston shoe becomes thereby able to operate under higher pressures, increased relative speeds and with better efficiency at assured perfect lubrication between neighboring faces.

8 Claims, 24 Drawing Figures

Fig. 4
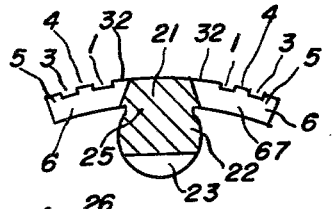
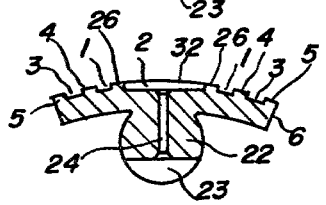
Fig.5
Fig. 3
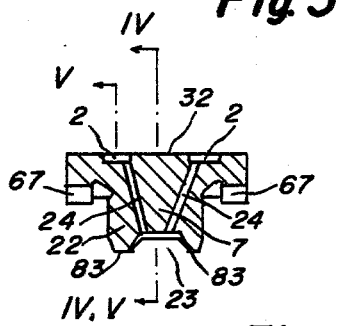
Fig. 6
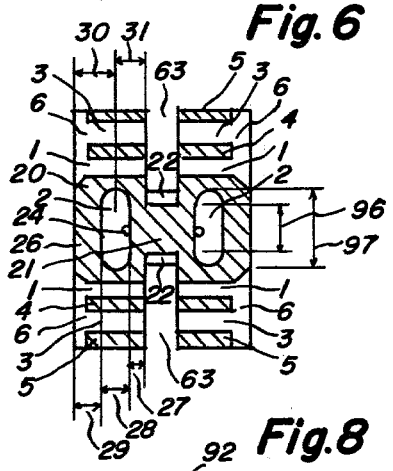
Fig. 7
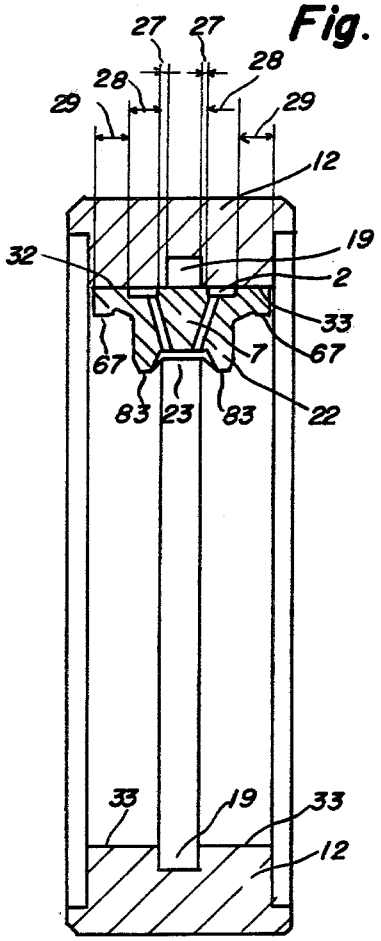
Fig.8
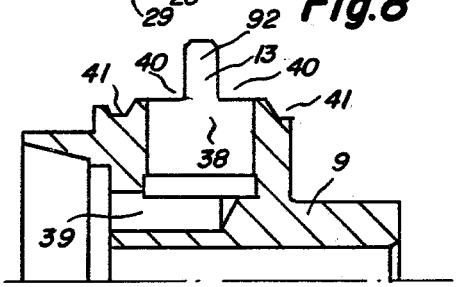
Fig. 9
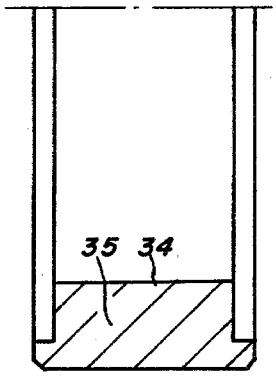

Fig.13
Prior Art
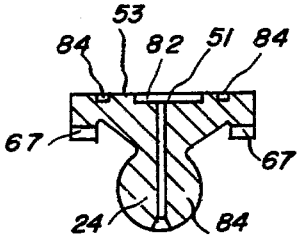
Fig.10
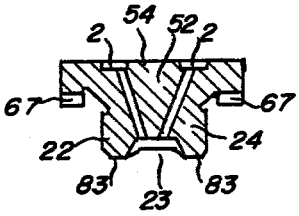
Fig.14
Prior Art
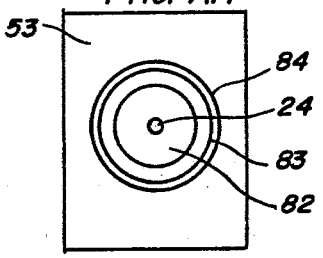
Fig.12
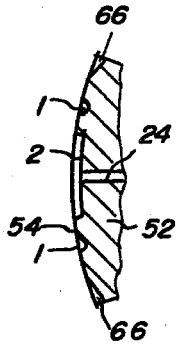
Fig.11
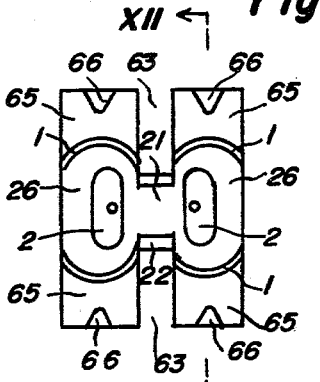
Fig.14a
Prior Art
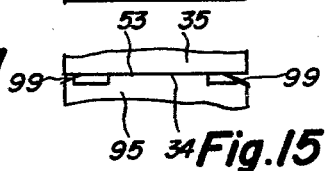
Fig.15
Prior Art
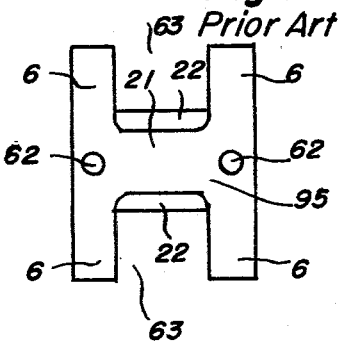
Fig.16
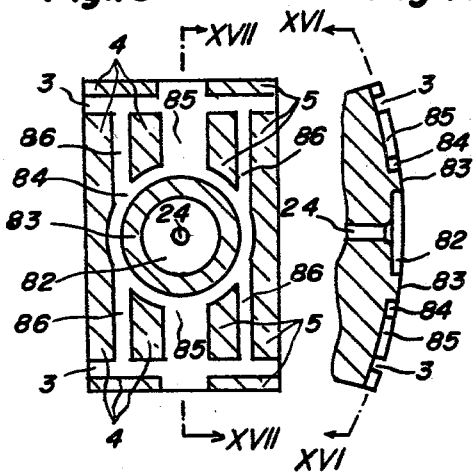
Fig.17

FIG. 18
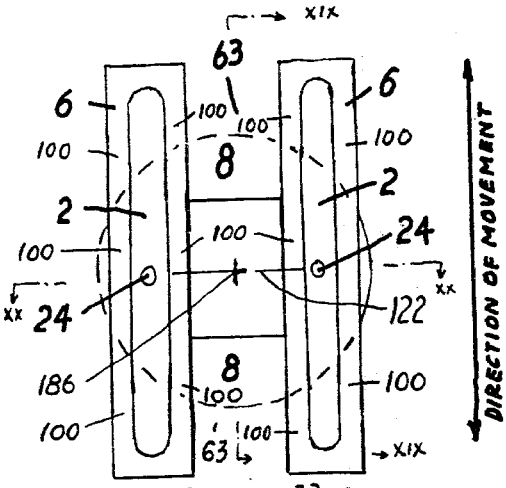
FIG. 19
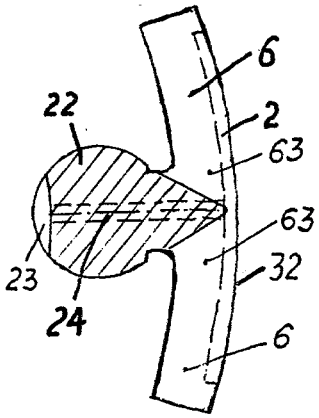
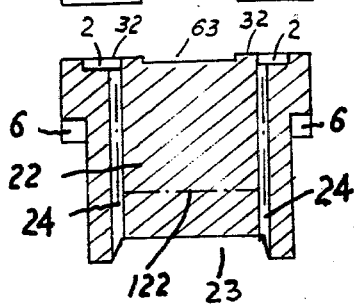
FIG. 20
FIG. 22 PRIOR ART
FIG. 23
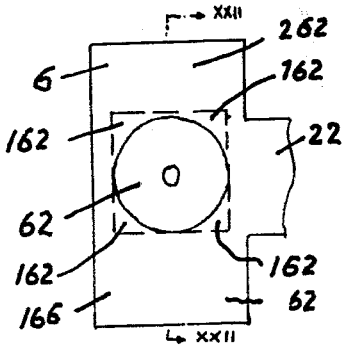
FIG. 21 PRIOR ART
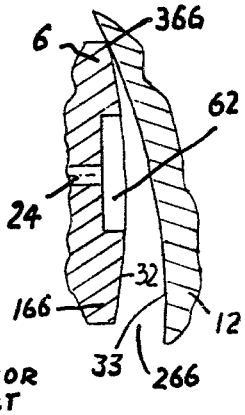
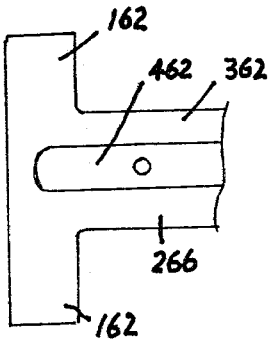

SLIDE FACES OF PISTON SHOES IN RADIAL PISTON MACHINES

REFERENCE TO RELATED APPLICATIONS

This is a continuation-in-part application of my copending application Ser. No. 537,352, filed Jan. 10, 1975 which is now abandoned and which was a continuation-in-part application of my earlier patent application Ser. No. 477,085, filed on June 6, 1974, now U.S. Pat. No. 3,951,047.

BACKGROUND OF THE INVENTION

The present invention relates to radial piston machines in general, of the type operating with hydraulic or pneumatic fluid, and more particularly to a novel piston shoe which is used in such radial piston machines.

Radial piston machines are already well known, for instance from my own prior U.S. Pat. Nos. 3,223,046, 3,277,834, and 3,304,883. These types of piston machines are suitable as motors, as pumps, compressors, and the like, and have a component which is provided with an inwardly directed annular control face within the confines of which a rotor turns, the rotor being provided with substantially radial piston bores in each of which a piston is reciprocable. The outer end of the piston carries a piston shoe by means of which it is in engagement with the control face.

The piston shoes disclosed in my prior U.S. patents mentioned above, are already provided with hydrostatic bearings by being formed, in their outwardly directed surfaces which face the control face, with depressions which communicate with bores in the piston shoe and the associated piston, and via these bores with pressure medium in the cylinder in which the piston reciprocates. Thus, the pressure medium can establish a hydrostatic pressure field between the outwardly directed surface of the piston shoe and the control face, the purpose being to reduce the friction between this surface and the control face and to make it possible to operate radial piston machines provided with such hydrostatic bearings at higher operating pressures.

My continuing investigations have shown, however, that these prior art constructions have certain disadvantages.

In particular, the depressions for forming the hydrostatic bearings were in form of blind bores formed in the outwardly directed surface of the piston shoe and communicating with a fluid supply passage in the latter. There was no means for precisely defining the boundaries of the hydrostatic pressure field. A further difficulty arose from the fact that these bores were located approximately centrally of the outwardly directed side faces of the piston shoes. These two factors brought with them disadvantages which become apparent only over a period of time, and only as the requirements made of radial piston machines in terms of higher operating pressures and greater speeds of rotation of the rotor began to increase. In particular, the arrangement of the bores wherein the hydrostatic bearings developed, at the center of the piston shoe contact surfaces, caused an "aging effect" to take place, in the piston shoe over a period of time, with the result that the outer ends of the piston shoe tended to bend radially inwardly (towards the rotor) by some thousands or even hundreds of a millimeter. This resulted in increased leakage of fluid outwardly from the hydrostatic pressure field, and consequently in an increased friction between the piston shoe and the control face; both of these factors increased even further, the higher the operating pressure of the radial piston machine became. It was found that these two factors influenced the effectiveness of the machine to such an extent that in the case of certain piston shoes the operational effectiveness of the machine dropped below 85%.

Moreover, the fact that a simple blind bore was formed in the outer piston shoe guide face also facilitated fluid leakage and increased friction.

It was by no means evident that the aforementioned problems were caused by the location and the manner of forming the bores wherein the hydrostatic pressure field developed. Rather, the reduced operating effectiveness of radial piston machines was generally considered a result of a defect of other components which cooperated with the radial piston machines, for instance electromotors, combustion engines, or gas turbines used to drive the radial piston machines.

SUMMARY OF THE INVENTION

According to the present invention is has now been realized that the aforementioned problems are the result of the construction of prior-art piston shoes in radial piston machines, and it is an object of the invention to overcome these problems.

My investigations have shown that in the prior art fluid was able to escape from the hydrostatic pressure field into the space between the piston shoe guide surface and the control face, and that at times an entry of fluid into this space took place from the chamber surrounding the rotor. In the latter case, this fluid formed an additional hydrostatic pressure field that was spaced from the actually desired hydrostatic pressure field, and which exerted upon the guide portion of the piston shoe a radially inwardly acting pressure tending to slightly tilt the piston shoe and cause contact and frictional sliding on adjacent components, with the result that significant friction developed which reduced the operational effectiveness of the radial piston machine. Moreover, the slight tilting of the piston shoe permitted increased leakage of fluid from the hydrostatic bearing. The friction and leakage losses which thus occurred were relatively insignificant if the fluid pressure acting in the radial piston machine was low, since in many radial piston machines the amount of play between the piston shoe and the annular control face is no more than a few hundreds of a millimeter. Evidently, this is the maximum extent to which such piston shoe could lift off the annular control face, and in the case of low fluid pressures this was not enough to cause really serious problems.

However, the requirements which radial piston machines are expected to meet, are becoming constantly more severe, and this is particularly true with respect to the demand that such piston machines should be able to operate at ever higher fluid pressures and at ever greater speeds of rotation. When the aforementioned problem occurs under these latter circumstances, however, it causes very severe difficulties. Thus, at operating fluid pressures of for instance 300 Bar and at rotor speeds of for instance 5,000 r.p.m. the amount of leakage and friction which can develop, even though the piston shoe can lift off the annular control face by only a few hundreds of a millimeter, can be so high that the operational effectiveness of the radial piston machine may drop below 85%. In machines operating under such high-performance conditions, however, the losses which are thus incurred in terms of operational effectiveness are most severe and unacceptable. This is especially true if the aforementioned problems occur in conjunction with the earlier-described slight bending of the piston shoe guide portion, in which case leakage and friction were found to increase beyond any possibility of acceptance. The mount of leakage increases at the cube of the gap increase resulting from the lift-off of the piston shoe contact surface from the control face, and the firction increases with the force at which the piston shoe is pressed against adjacent components.

The magnitude of the problem can be understood from some single examples. If, for instance, a 50 cc radial piston machine operates at a fluid pressure of 350 Bar and at a rotor speed of 5,000 r.p.m., its output may amount to 195 hp; a loss of 15% due to friction and leakage then amounts to a loss in excess of 29 hp. The problem is even clearer when related to the type of radial piston machine in which the known piston shoes are arranged in pairs, as also disclosed in the prior art. Such a machine may have a dual stroke value of two times 50 cc, and may weight as little as 11 kg. If such a machine is operated at the aforementioned parameters, that is at 350 Bar fluid pressure and at 5,000 r.p.m., its output may amount to approximately 390 hp. A 15% loss from this rated figure due to the aforementioned leakage and friction problems will amount to approximately 58 hp. This represents not only a significant deterioration in the operation effectiveness of the machine, but it brings with it other problems which further aggravate the situation. Evidently, this large loss will be converted into heat acting upon the components of the machine and upon the pressure fluid. In so small a machine the surface area acting as a heat sink, that is from which this heat can be radiated, is much too inadequate, so that the machine will rapidly be subjected to temperatures at which not only the pressure fluid will become heated but at which thermal expansion of machine components will take place. Such thermal expansion decreases the gaps between moving components and increases the friction, or in some instances it may result in an increase of such gaps (i.e., in dependence upon the direction of expansion) and will then lead to increased leakage.

The present invention avoids all of the aforementioned problems in that it provides, in a radial piston machine of the type having a rotor which turns within the confines of a surrounding annular control face and is provided with substantially radial cylinder bores each accommodating a radially slidable piston having an outer end provided with a piston shoe which is formed with guide portions projecting circumferentially of the rotor beyond the associated piston and having contact faces in sliding engagement with the control face, each of these contact faces having a hydrostatic bearing constituted by a depression which is surrounded by a sealing land, an improvement which comprises forming recesses outwardly spaced from the respective sealing lands so as to separate the latter from outwardly adjacent portions of the contact faces.

Moreover, a further concept of the invention involves making the depression in which the hydrostatic pressure field constituting the bearing develops, of a form which is elongated in direction transverse to the axis of rotation of the rotor, rather than making the depression circular, and has often been the case in the prior art.

The measures according to the present invention avoid the aforementioned radially inward bending of the piston shoe guide portions, or at least reduce it to so small a value that the losses resulting from such bending remain acceptably small even though the machine is operated at high fluid pressure. The depressions in which the hydrostatic bearings develop, hereafter for the sake of convenience called the hydrostatic pockets, are now so closely adjacent—in a manner which will be described subsequently—that the bending moment exerted by the pressure in these pockets and acting upon the piston shoe is substantially smaller than in the prior-art constructions.

Furthermore, the portions of the piston shoe guide faces which are outwardly spaced from the hydrostatic bearing, and separated from the same in accordance with the present invention, are so small in their dimensions—while separated into several separate surface portions—that it is impossible that between them and the control face hydrostatic pressure fields could develop which would be sufficiently strong to cause significant lifting-off of the piston shoe guide face from the control face.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is an axial section through a piston shoe according to the invention;

FIG. 4 is a section taken on line IV—IV of FIG. 3;

FIG. 5 is a section taken on line V—V of FIG. 3;

FIG. 6 is a top-plan view of FIG. 3;

FIG. 7 is an axial section through a piston control ring and a single piston shoe accommodated within it;

FIG. 8 is a fragmentary axial section through another piston control ring with which the piston shoe according to the present invention can be employed;

FIG. 9 is a fragmentary axial section through a further piston control ring with which the piston shoe according to the present invention can be employed;

FIG. 10 is an axial section through a piston shoe according to a further embodiment of the invention;

FIG. 11 is a top-plan view of FIG. 10;

FIG. 12 is a section taken on line XII—XII of FIG. 11;

FIG. 13 is a view similar to FIG. 10, but illustrates by way of comparison a prior-art piston shoe;

FIG. 14 is a top-plan view of FIG. 13;

FIG. **14*a*** is a fragmentary section through a control ring and a piston shoe according to the prior art;

FIG. 15 is a top-plan view of a further prior-art piston shoe;

FIG. 16 shows how the piston shoe of the former art of FIG. 14 is improved by this invention and is a sectional view through FIG. 17 along the line XVI—XVI; and FIG. 17 is a cross-sectional view through FIG. 16 along line XVII—XVII.

FIG. 18 is a top-plan view of the piston shoe of another embodiment of the invention;

FIG. 19 is a cross-sectional view through FIG. 18 along the lines XIX—XIX;

FIG. 20 is a sectional view through FIG. 18 along the lines XX—XX;

FIG. 21 is an enlarged view of a piston shoe outer face of the prior art;

FIG. 22 is a cross-sectional view through FIG. 21 and through a portion of the neighboring piston stroke guide member in an enlarged illustration; and FIG. 23 is a view of a portion of the piston shoe of another embodiment of the prior art.

DESCRIPTION OF THE PREFERRED EMBODIMENTS

It should be understood that in the description following hereafter, several concepts of the invention will be explained separately, together with the reasoning applicable to them and in conjunction with discussions of their respective effects upon the operation of a radial piston machine.

Figure 1:
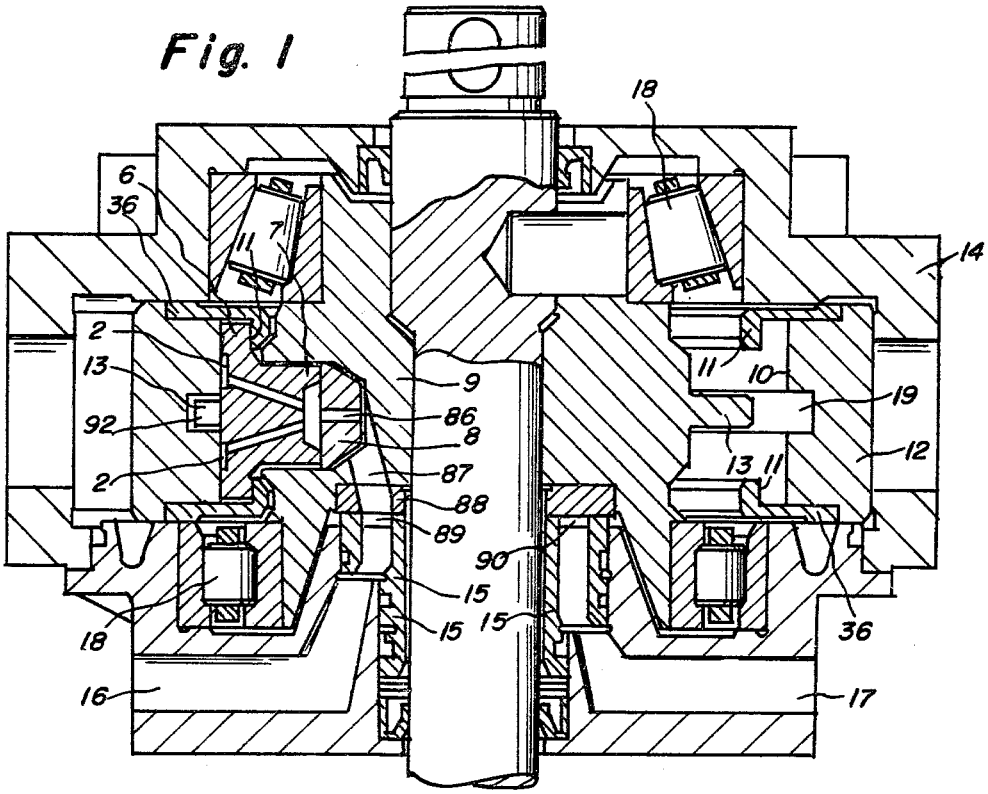
FIG. 1 is an axial section through an exemplary radial piston machine provided with a piston shoe according to an embodiment of the invention.
Figure 2:
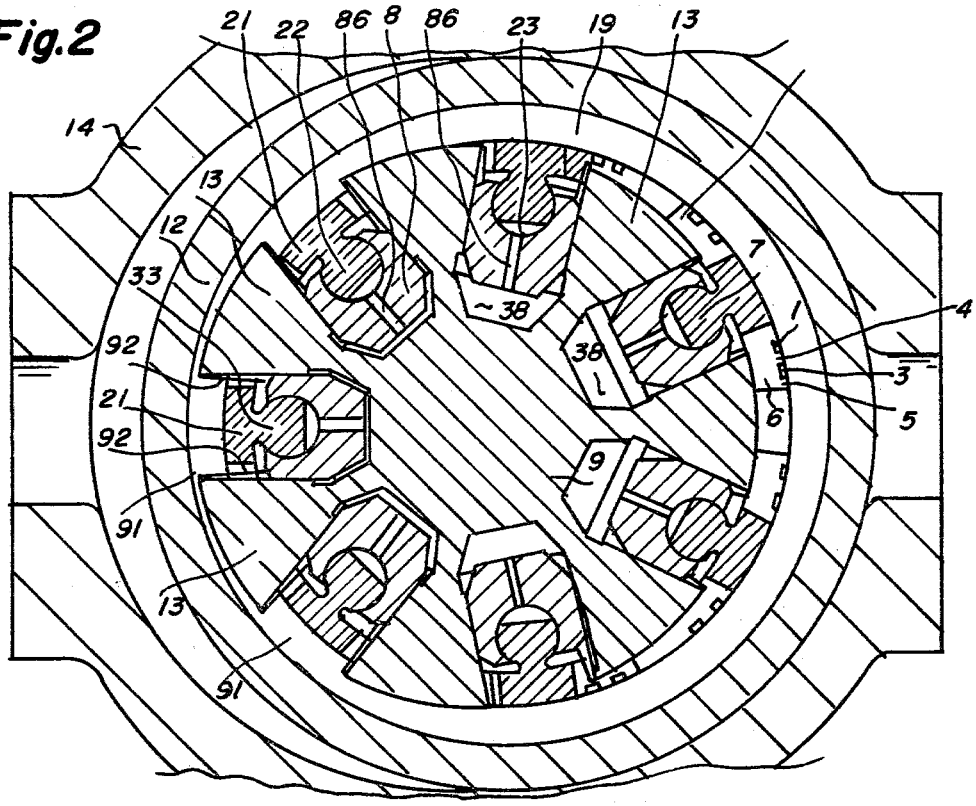
FIG. 2 is a section taken on line II—II of FIG. 1.

It should also be understood that in FIGS. 1 and 2 I have illustrated purely by way of example a radial piston machine wherein the present invention can be employed, and indeed is shown as being employed; however, it should be understood that the present invention can also be employed in differently constructed radial piston machines.

With this in mind, FIG. 1 will be seen to show a radial piston machine having a housing 14 wherein a rotor 9 is journalled for rotation in bearings 18. The rotor 9 is provided with a plurality of substantially radially extending cylinder bores 38 which define fluid chambers for passage of a pressure fluid. The fluid flow into and out of the piston machine takes place via the ports 16, 17, the control ports 89, 90, and the rotor channels 87. As also shown, a valve plate 88 and a control body 15 may be provided which aid in the distribution of the fluid flow. Each of the cylinder bores 38 accommodates a piston 8 which during the rotation of the rotor 9 reciprocates radially inwardly and outwardly as the volume of the fluid chambers, which are defined in the cylinder bores 38 by the aid of the pistons 9, alternately increases and decreases during entry and exit of fluid therefrom.

The radially outer ends of the pistons 8 are formed with axially extending recesses in which pivoting heads 22 of piston shoes 7 are pivotably received. The inner ends of the portions or heads 22 are formed with recesses 23 (compare for instance FIG. 4) in which hydrostatic pressure fields develop which communicate with the interior of the respective fluid chamber in the bore 38 via a passage 86 and the associated piston 8. The heads 22 are connected with a piston shoe main portion by means of a neck 25, of reduced cross-section; the piston shoe main portion which has the purpose of providing for the control of movement of the piston shoe and hence the piston 8, has a central part 21 which extends laterally beyond the opening of the cylinder bore 38 parallel to the axis of rotation of the rotor 9 and is subdivided by cutouts 63, being provided at its ends with the piston shoe guide portions 6 which extend transversely to the rotor axis. The rotor 9 is formed with a slot 91 into which the central portion 21 can enter when the piston shoes 7 and associated cylinders 8 move inwardly. The rotor 9 is surrounded by a control member 12 which may be a ring and may be rotatable or stationary, but which has an inner circumferential surface 10 that faces the rotor 9 and with which the guide portions 6 are in sliding contact to be moved inwardly of the rotor 9 by such contact during the rotation of the rotor in alternation with movement outwardly of the rotor.

The cutouts 63 are located between the guide portions 6 of the respective piston shoe 7 and the rotor ribs 13 extend into them between the rotor transverse slots 91 as the rotor 9 turns. The inner circumferential guide face of the control ring 12, which latter may be stationary or turnable as previously pointed out, may be a circumferentially complete guide surface 34, as shown in FIG. 9, in which case the ring 12 will be configurated in the manner of the element which is identified with reference numeral 35 in FIG. 9. Alternately, the piston shoe guide face may have two guide face portions 33 which are subdivided by a groove 19 which is formed in the ring 12 in radially outward direction, as shown in FIGS. 1, 2 and 7.

For reasons of efficiency, it is desirable that the piston stroke be as large as possible; to make this come about, it is absolutely necessary that the piston shoe 7 be provided with the cutouts 63 shown in FIGS. 6 and 11, to assure that even its radially outermost portions can pass the rotor ribs 13 and enter into the rotor transverse slot 91. Another measure provided in conjunction with the desire to obtain a maximum stroke are the piston guides 92, shown in FIGS. 1, 2 and 8 as being provided on the rotor ribs 13, which piston guides bound the rotor transverse slots 91.

The present invention is specifically directed to piston shoes having the aforementioned cutouts 63. By way of contrast and further explanation, I have shown in FIGS. 13 and 14 a piston shoe of the prior art which does not have the cutouts 63 and in general does not obtain the advantages and objectives of the present invention. The piston shoe shown in FIGS. 13 and 14 is described and illustrated in "Oilhydraulic Power and its Industrial Applications" 1960, published by the McGraw Hill Book Company, New York, page 118. This prior-art piston shoe cannot enter into the rotor slot 91 because it does not have the cutout 63, and therefore cannot make possible as large a piston stroke as the piston shoes according to the present invention.

The prior-art piston shoe in FIGS. 13 and 14 is provided with a hydrostatic bearing 82, sealing lands 83 for the same, and an annular groove 84 which surrounds the sealing lands 83, and a connecting bore 24 through which latter the hydrostatic bearing 82 receives hydraulic fluid under pressure from the piston and from the cylinder. This piston shoe has a guide face 53 which, if the piston shoe were accommodated in the control ring 35 of FIGS. 9 and 14*a*, would be in sliding engagement with the control face 34, and the latter would serve to close off the hydrostatic bearing 82 against loss of pressure fluid.

It should be understood that this prior art piston shoe operates perfectly well at certain rotational speeds of the rotor. However, extensive examinations and measurements have shown that while this piston shoe of this prior art operates satisfactorily for instance in the range of 100–1,500 r.p.m., its leakage is relatively high, as well as its friction with respect to the associated control ring. Even within this range, however, there are certain rotational speeds, for instance on the order of 800 r.p.m. or lower, at which the prior-art piston shoe tends to become heated due to excess friction at certain pressures, for instance at a pressure of approximately 200 atmospheres. When the piston shoe was used in a piston control ring 35 of the type shown in FIG. 9, small welded spots were found to occur between its guide face 53 and the control face 34 under these conditions, and these weldments occurred spontaneously and were broken up again during further rotation of the rotor, with the result that these weldments then formed deep grooves in the cooperating surfaces 53 and 34, leading to a destruction of the hydrostatic bearing 82, the lands 83 and ultimately the effectiveness of the complete piston shoe of FIGS. 13 and 14. The final result was a drop in the operational effectiveness of a machine provided with such a piston shoe, to or near zero. On the other hand, when the rotational speed of the rotor provided with such piston shoe was increased to and beyond 2,000 r.p.m., the leakage of fluid from the piston shoe, and more particularly from the hydrostatic bearing 82, increased constantly and in the neighborhood of 3,400 r.p.m. reached such high values that the effectiveness of the machine again dropped far below 85%, and the machine no longer could be practically used.

The manifold tests and observations which have been conducted in connection with the above-identified observations have led me to the conclusion that at rotational speeds below a certain level insufficient hydrostatic pressure fluid remained between the guide face 53 of this prior-art piston shoe and the control face 34 of the control ring 35. In almost all instances where examinations were conducted with this type of piston shoe, the heating occurred approximately in the middle between the four corner regions of the guide face 53. On the other hand, my observations led me to the conclusion that at rotational speeds in excess of a certain r.p.m., too much hydraulic pressure fluid from the surrounding space in the interior of the machine was able to enter along the interface between the guide face 53 and the control face 34, thus lifting-off the former from the latter so that the piston shoe was no longer properly in sealing engagement with the control face 34, permitting a large quantity of pressure fluid to escape from the hydrostatic bearing 82 and into the surrounding area outside the outline of the guide face 53. It became finally clear that the guide face 53 of the prior-art piston shoe of FIGS. 13 and 14 was so large that insufficient pressure fluid remained between it and the control face 34 at relatively low r.p.m., and that at relatively high r.p.m. such high hydrodynamic forces became active between the control face 34 and the too-large guide face 53 that these forces lifted the piston shoe off the control face 34.

This understanding is reflected in a further aspect of the present invention, according to which it is important that the piston shoe guide face, which is to come in contact with the control ring control face, must be of such dimensions that even at small rotational speeds of the rotor there will be sufficient pressure fluid between the piston shoe guide face and the control face of the control ring, whereas at high r.p.m. the hydrodynamic forces which develop between these two faces must not be allowed to become so high that they can lift the guide face off the control face. Consequently, the invention makes provision for making the piston shoe guide face sufficiently small to meet these requirements. This guide face is, in fact, made too small to permit any hydrodynamic pressure fields to develop between it and the control face, thus permitting the closest and most intimate possible sealing contact of the piston shoe guide face on the control face of the control ring, and assuring that leakage of fluid out of the hydrostatic bearing of the piston shoe is reduced to the absolute minimum and the effectiveness of the machine is consequently increased.

FIG. 15 shows a piston shoe 95 which is provided with the cutouts 63 between the guide portions 6, and which has a central portion 21 which connects the guide portions 6 and which is smaller than the rotor slot 91 into which it enters during rotation of the associated rotor. This piston shoe 95 is therefore suitable for a construction in which a large piston stroke is required, and can be used in machines capable of handling very high and highest fluid flow quantities per unit of time. The piston shoe of FIG. 15 has been found even at pressures far in excess of 100 Bar to produce operational effectiveness far in excess of 90% in machines in which it was used. However, at pressures in the region of and in excess of 200 Bar it was found that an initially insignificant decrease of the effectiveness of machines having the piston shoes of FIG. 15 occurred. As the pressures were increased, the decrease in the effectiveness became more marked and when, finally, precise tests and examinations were carried out with respect to the piston shoe 95 of FIG. 15, it was found that in this piston shoe the guide portions 6 are so small that no hydrodynamic pressure fields can develop between the guide faces of the guide portions 6 and the associated control faces 33 of the ring 12, or the control face 34 of the ring 35. At least, no hydrodynamic pressure fields could develop which would have been strong enough to lift the piston shoe off the associated control face, because any beginning development of a hydrodynamic pressure fluid would have immediately resulted in outflow of its fluid laterally beyond the confines of the portions 6, because of the narrowness of the latter, so that an effective development of a hydrodynamic pressure field could not have taken place.

In some respects, this is desirable because the piston shoe 95 of FIG. 15 is known to have a tight sealing engagement with the control faces 33 or the control face 34, thus reliably sealing its two hydrostatic bearings 62 against outflow of fluid. However, this in turn brought with it a disadvantage which became uncovered only in the course of the theoretical and practical investigations on which the present invention is based, namely the fact that in the very narrow space at the interface of the guide faces of the portions 6 and the control faces 33 or the control face 34, a so-called "uncertain zone" developed, as I preferred to call it. The term "uncertain zone" should be understood to refer to such a narrow gap between two abutting or relatively slidable surfaces, wherein the pressure distribution cannot be reliably calculated and tends to vary in an uncontrollable manner.

Generally speaking, it is well known that when pressure fluid enters into a gap of this type at one end at a higher pressure than the pressure which prevails at the opposite end of the gap, the pressure that prevails in the gap will decrease from the higher pressure side to the lower pressure side approximately linearly, or else in form of an only slight curve. For this reason it is possible to make the reliable assumption that the pressure in such a gap, summed up for the individual loci in the gap, constitutes approximately the median pressure between the two ends of the gap, or is slightly below a pressure that is midway between the high and low pressure at the opposite ends of the gap. However, the contact of the guide faces of the portions 6 of the piston shoe 95 in FIG. 15 with the control faces 33 or the control face 34 was so close that in effect there was no gap between these faces, and it was not possible for fluid pressure to travel through this non-existent gap in longitudinal direction of the guide faces 6. What occurred instead was that pressure fluid leaked from the hydrostatic bearings 62 and travelled longitudinally of the respective guide portions 6, but only for a part of the length of these guide portions. It has not been possible until now to determine exactly how far the pressure fluid travelled and what the pressure conditions were. It can be assumed, however, that a median depth of penetration from the hydrostatic bearings 62 in longitudinal direction of the guide portions 6 occurred, amounting to approximately 3–5 mm., and of course this was the less the more precisely the guide faces of the portions 6 and the cooperating control faces were machined. This resulted in the aforementioned "uncertain zone" wherein pressure conditions could not be calculated or determined, and this in turn meant that one such piston shoe 95 would have a higher friction with respect to the control ring, another piston shoe 95 would have a lower friction, one would have a greater leakage of fluid from the hydrostatic bearings 62, another lesser leakage, and so on. This, despite the fact that all piston shoes were theoretically identical. The relative speed of movement of the relatively movable components, the accuracy of machining of the contacting surfaces, and the material used for the piston shoes and the control rings also played roles which could be neither controlled nor properly calculated.

Here, also, the present invention provides relief in converting the aforementioned "uncertain zones" into what I prefer to call "certain zones" or "zones of certainty". This is achieved according to the invention in that the dimensions of the sealing lands for the hydrostatic bearings 2 (see FIGS. 4, 5, 6, 11 and 12) in the guide portions 6 of the piston shoes according to the invention are so decreased that even in case of the tightest possible engagement of the piston shoe guide faces with the associated control face or faces there will be fluid present in the gap between these faces, thus converting the sealing zone from a "zone of uncertainty" into a "zone of certainty" in which pressure conditions can be calculated and forecast. To achieve this the present invention provides recesses 1 which are formed in the piston shoe guide portions 6, as shown in FIGS. 4, 5, 6, 11 and 12. As a result of this the sealing lands 26 surrounding the hydrostatic bearings 2 which are filled with pressure fluid, become so short—in direction normal to the elongation of the hydrostatic bearing 2—that the pressure fluid will always be present on these sealing lands 26 in form at least of a very thin film, because due to this short dimension in the aforementioned direction there will always be some pressure fluid which can travel through even the smallest unevennesses in these surfaces of the lands 26 despite the fact that these lands may very tightly contact the control faces 33 or 34.

A further concept that has been developed according to the present invention is that despite the development of a "zone of certainty" the sealing gap between the piston shoe guide faces and the associated control faces will never be completely predictable as to the pressure conditions which will prevail in it, and the pressure conditions will never be entirely constant. In order to further overcome and reduce the problems which are posed by this, the present invention proposes still a further step, namely to make the sealing lands relatively small in relation to the cross-section of the absolutely safe zone of the hydrostatic bearings 2. This is accomplished by making the cross section through the bearings 2 substantially larger than was previously the case, elongating the hydrostatic bearings 2 in the guide portions 6 in parallelism with the elongation of these guide portions 6, as shown for instance in FIG. 11.

This is particularly important in the case of radial piston machines having a long piston stroke and high capacity. In the case of axial piston machines there is as a rule only a single hydrostatic bearing provided in the associated piston shoe, but in the case of radial piston machines of the type mentioned above, it is necessary to provide at least one hydrostatic bearing for each of the two guide portions 6 of the piston shoe. This means, however, that with respect to the hydrostatic bearings such piston shoes are particularly sensitive and require a much better sealing effect and therefore a narrower sealing gap than hydrostatic bearings in axial piston machines. By elongating the hydrostatic bearings 2 in a manner shown for instance in FIG. 11, a particularly long but narrow hydrostatic bearing is obtained which is no longer round as previously customary. On the other hand, the elongated hydrostatic bearing has a greater circumference than the circular one and should therefore theoretically be subject to greater amounts of leakage than a circular one under identical sealing conditions. This problem is avoided by having the hydrostatic bearings 2 which are elongated in accordance with the present invention, be located particularly tightly against the control faces 33 or 34, which is achieved by reducing the dimensions of the sealing lands.

This measure provides the piston shoe according to the present invention with a rather large "zone of certainty" as related to the "zone of uncertainty", making it possible to more precisely calculate the radial balancing of the piston shoe and to obtain a more reliable and constant operation, reducing the friction between piston shoe and control face 33 or 34 to a minimum, and at the same time decreasing the leakage from the hydrostatic bearings 2 also to a minimum, with the result that the operational effectiveness of the machine is increased.

The invention provides another advantage that was not previously present in the prior art, and which is based on an understanding of a phenomenon that was not previously realized. Prior-art piston shoes of the type for instance shown in FIG. 15, having the circular hydrostatic bearings 62 located at the center of the respective guide portions 6, can undergo—in the case of high pressure—a slight bending in direction inwardly away from the control face 33 or 34. The reason for this is that the centrally located hydrostatic bearings 62 are too far removed from the center of the piston shoe center part 21 which is reinforced by the pivot head 22. As a result of this, the pockets 99 can develop which are shown in FIG. 14*a*, where a portion of the piston shoe 95 of FIG. 15 is shown in contact with a control ring 35. In the case of high pressure these pockets 99, which are at opposite axial sides of the hydrostatic bearings 62, can cause deformations or bending of the guide portions 6 and permit the escape of a substantial amount of leakage fluid from the respective hydrostatic bearings 62. This not only reduces the volumetric effectiveness of a machine provided with such piston shoes, but also reduces the effectiveness of the piston shoe to in effect "float" in sliding relationship on the control face 33 or 34, because such strong leakage can reduce the pressure in the hydrostatic bearings 62 and can result in sufficient friction between the piston shoes and the control ring 12 or 35 to cause heating of these components and possibly even seizing.

These problems are avoided by the present invention in that the hydrostatic bearings 2 are located no longer at the center of the guide portions 6, as for instance in FIG. 15, but instead are offset towards one another in inwards direction, that is transversely to the elongation of the guide portions 6, in the manner in which this is shown for instance in FIG. 11, and in FIGS. 6 and 7 also. In FIGS. 6 and 7 this is made clear in that the center lines through the elongation of the hydrostatic bearings 2 have a smaller distance 31 from the inner ends of the respective guide portions 6 than the distance 30 from the outer ends thereof.

In this manner, the hydrostatic bearings 2 are located at least generally on the axial extension of that portion of the respective piston shoe which is reinforced by the presence of the pivot head 22, and where radial deformations are for all intents and purposes impossible because of the support by this reinforcing pivot head 22. Thus, the present invention makes it impossible for the pockets 99 of FIG. 14*a* to develop. On the other hand, the invention assures that an increased sealing surface 29 is provided in the FIGS. 6 and 7, so that even if a small pocket 99 should develop, the leakage flow which could escape through it, would have to be smaller—due to the greater extension of the sealing surface 29—than was the case in the prior art. This means that the present invention provides for an accomodation of the hydrostatic sealing conditions to the static stability conditions in the region of the piston shoe guide portion 6, a consideration which was not heretofore at all taken into account in the prior art. This lack of an understanding of this factor in the prior art was an important reason for the failure of many prior art piston shoes at high pressures.

Since in the case of a slight deformation of the piston shoe in the manner shown in FIG. 14*b* the sealing surface 27 will be in tighter contact with control face 33 or 34 than the sealing surface 29 located at the opposite side of the hydrostatic bearing (compare FIGS. 6 and 7), the sealing surface 27 must be shorter than the sealing surface 29, so that the unequally tight contact of these surfaces 27, 29 with the guide faces 33 and 34 will be compensated-for, in that pressure fluid will in the one case have to penetrate a gap which is shorter than in the case of the other gap. Evidently, in the case of the two gaps the fluid entry between the surfaces 27, 29 and the cooperating surfaces 33 or 34 will be unequal, unless the surfaces 27, 29 are made of different size as proposed by the invention, which will have an equalizing effect on the fluid entry into the respective gap, inasmuch as the gaps will then be of different size as to their length although not as to their width.

Finally, still a further concept of the invention requires to be mentioned, as it is based upon another understanding of piston shoes which is important in the context of the invention. It has been realized that the piston shoe must be as short as possible in its dimension which extends longitudinally of the axis of rotation of the rotor; in other words, this would be the direction transversely to the elongation of the guide portions 6, that is from left to right in FIGS. 6 and 7, by way of example. This has two advantages, in that it permits the axial length of a piston machine utilizing such a piston shoe to be small, thus making it possible to construct the machine in a space-saving manner. On the other hand, and even more importantly, this measure makes it possible to obtain an improved resistance of the piston shoe to flexing and other deformation, particularly in direction circumferentially of the rotor. However, it has been pointed out earlier herein that the cutouts 63 between the piston shoe guide portions 6 are absolutely necessary, if the piston shoe is to make possible a large piston stroke. The cutouts 63, on the other hand, must be broad enough to permit the rotor ribs 13 to enter between them, and this then dictates a certain minimum dimension of the piston shoe in the aforementioned direction along the rotor axis. This means that the only manner in which this dimension can be made as small as possible, requires that the width of the piston shoe guide portion 6 in this direction be made as narrow as is technically feasible. This is counterbalanced by the requirement that the outline of the hydrostatic bearings 2 be relatively large in order to assure a high ratio of the cross-section of the aforementioned "zone of certainty" with respect to the surrounding "zone of uncertainty".

The present invention meets all of these requirements by deviating from the previously used circular configuration of the hydrostatic bearings and instead elongating the hydrostatic bearings 2 in direction of the greatest dimension of the piston shoe guide portions 6. This is shown, by way of example, in FIG. 6, where the hydrostatic bearings 2 will be seen to be elongated in this manner, being fed with pressure fluid via the fluid passges 24 that open into them. However, in and of itself this measure is not sufficient to avoid all problems, because the elongation of the hydrostatic bearings 2 and consequently their greater circumference as compared to hydrostatic bearings of circular configuration, means that potentially there will be increased amount of fluid leakage out of the bearings due to the increase in the bearing circumference. This is avoided by further decreasing the gap existing between the juxtaposed guide faces of the piston shoe guides 6 and the control faces 33 or 34, being mindful of the fact that leakage through a gap decreases as the width of the gap decreases, so that a reduction of the gap width by half results in an eightfold reduction of leakage out of the gap.

Given these considerations, it was realized that measures would be required to avoid any increases in the gap width, that is the distance between the guide faces of the piston shoe guide portions 6 and the juxtaposed control faces 33 or 34. However, as pointed out earlier, increases in this gap width are very often the result of the development of hydrodynamic pressure fields in these gaps. It is therefore necessary to prevent the development of such hydrodynamic pressure fields, which is achieved in accordance with the present invention—with a resulting narrowing of the gap to the least possible extent—in that the surface portions 4, 5 (see for example FIGS. 4, 5 and 6) of the piston shoe guide portions 6 which are located outwardly of the recess 1 surrounding sealing lands 26, are made as small as possible. This is achieved by breaking up these surface portions 4, 5 in that the recesses 3 are formed in them as shown in the aforementioned Figures. FIGS. 4 and 5, in particular, show that the center of the pivot head 22 of the respective piston shoe 7 has a certain distance from the outer face 32 of the piston shoe. In actual operation the piston shoe 7 would therefore tend to tilt if the piston shoe guide portions 6 were to have only the respective sealing lands 26 which surround the respective hydrostatic bearings 2, because these sealing lands 26 are relatively short in the direction of movement of the piston shoe 7 with its rotor, by comparison to the spacing of the center of the pivot head 22 from the outer face 32. It is therefore necessary for a reliable operation of the novel piston shoe 7 that the piston shoe guide portions 6 be sufficiently long to avoid this problem, and that they have the surface portions 5 located in the region of their outermost ends which serve a stabilizing purpose to prevent such tilting. This, however, then tends to bring with it the danger that the aforementioned undesired hydrodynamic pressure fields may develop, but for the measure just outlined above, namely breaking up or subdividing these surface portions of the piston shoe guide portions 6 by means of the recesses 3 and subdividing them into the surface portions 4 and 5. The surface portions 4, and 5 and the length of the recesses 3 may be shortened, if desired, in the direction transverse to the elongation of the piston shoe guide portions 6; that is in direction from left to right in FIG. 6, for example. This prevents the development of excessively strong hydrodynamic pressure fields between the surface portions 4, 5 and the juxtaposed control faces 33 or 34, and thus assures a tight juxtaposition of these surface portions and control faces and guarantees a gap between them of minimum width.

FIG. 6, just mentioned above, also shows that the dimension 97 of the hydrostatic bearings 2 is greater than the dimension 28 which is normal to the dimension 97. It is currently preferred that the hydrostatic bearings 2 have transversely spaced parallel walls which are parallel with one another over the dimension 96 and which then merge with semi-circular end portions having a radius corresponding to half the dimension 28 and, in conjunction with the dimension 96, amounting to the aforementioned dimension 97. This configuration can be produced particularly easily without requiring highly specialized equipment. However, other configurations could be selected for the hydrostatic bearings 2, for instance rectangular or other shapes.

The embodiments whihh have been discussed thus far are all concerned with piston shoes and fluid operated machines in which a very tight contact of the piston shoe guide portions with the associated control faces 33 or 34 is assured and possible, due to acceptable relative speeds of displacement between them. This is almost always the case where the control ring is of the type which rotates together with the rotor, for instance the type of control ring designated with reference numeral 12 in preceding Figures. However, in certain instances, and especially in the case of control rings 12 or 35 which do not rotate but instead are stationary, and in addition when the machine is to operate at high rotational speed, it may occur that the piston shoe would become heated due to friction if it is too tightly in engagement with the associated control faces 33 or 34, or if the piston shoe is not made of a particularly selected low-friction material, sinter metal or sinter metal-like material or porous material. In such circumstances, the invention provides for a construction in which a hydrodynamic bearing serves to develop a fluid pressure field between the piston shoe guide portions 6 and the juxtaposed control faces 33 or 34. This bearing, or rather the pressure fluid field, must be just sufficiently strong to obtain and maintain the desired gap width between the guide faces of the piston show guide portions 6 and the juxtaposed control faces 33 or 34. This hydrodynamic bearing must be spaced from the hydrostatic bearing in at least one of the piston shoe guide portions 6 associated with the particular hydrostatic bearing 2. It must have an area large enough for a fluid pressure field to develop which is just able to lift the piston shoe 7 sufficiently away from the associated control face 33 or 34 to obtain between them a gap of desired width. The calculation must be such that the desired gap width is obtained which constitutes the optimum for the operating pressure at which the machine is to operate, and for the most frequently used number of revolutions per minute. In practice this means that the hydrodynamic bearing, identified in FIG. 11 with reference numeral 65 as to its area, must be so dimensioned that the fluid pressure field which develops over this area is sufficiently strong to lift the piston shoe guide portions 6 out of direct contact with the associated control face 33 or 34 to such an extent, but only to such an extent, that the sum of the friction losses and leakage losses resulting from the interaction of the piston shoe 7 and its associated control ring 12 or 35 represents a minimum possible combined loss. It is evident that if the gap becomes too great because the pressure field becomes too strong, leakage losses from the hydrostatic bearing would be too great.

The requirements as mentioned above are met in that hydrodynamic bearings 65 are permitted to exist only in the end regions of the piston shoe guide portions 6, and are separated from the respectively associated hydrostatic bearing by a recess, namely the recess 1. To assure forced entry of fluid into the bearings 65 from the space surrounding the respective piston shoe, it is advantageous to provide the illustrated pockets, bevels or other depressions 66 at the outer tips of the piston shoe guide portions 6, so that during the movement of these guide portions 6 along the respective control face 33 or 34 sufficient fluid will be forced to enter the respective bearing 65 from the space surrounding the piston shoe 7. It is important that the hydrostatic bearing 2 be separated from the respectively associated hydrodynamic bearings 65 by the recesses 1, or analogous recesses, because otherwise the bearings 2 and 65 would interact in a difficult to control manner which would have adverse effects upon the operation of an apparatus provided with this piston shoe.

Finally, it has been observed that the sealing lands surrounding the hydrostatic bearings in the pivot heads of the prior art piston shoes, corresponding to the pivot heads 22 of the novel piston shoe disclosed herein, were too wide to obtain a proper equilibrium between the pressure field developing in this hydrostatic bearing and the one identified with reference numeral 2 in the present application. The present invention overcomes this problem in that it elongates the hydrostatic bearing 23 in the pivot heads 22 of the respective piston shoe 7 in the direction parallel to the longitudinal axis of the respective pivot head 22, for example in direction normal to the plane of FIG. 3 or FIG. 10. The result of this is that the elongation of the hydrostatic bearing 23 in this direction is greater than the width of the sealing lands 83 which surround it, whereby a better operation of the hydrostatic bearing 23 and of the machine overall is obtained.

In FIG. 18 a piston shoe of another embodiment of the invention is seen from above. FIG. 19 is the cross-sectional view through FIG. 18 along the line XIX—XIX and FIG. 20 is the sectional view through FIG. 18 along the line XX—XX. Reference number 8 indicates the piston below the piston shoe and is illustrated by the dotted line around the center of FIG. 18. The novel feature of the embodiments of these figures is that the piston shoe is very narrow in the direction of pivot axis 122. The fluid pressure balancing pocket recesses, also called "depressions" are therefore very close to the axis of the piston. The medial portion of the piston shoe remains well within the defines of the radial extension of the piston, or in other words, within the circle of piston 8 outlined by the dotted line in FIG. 18. This closeness or narrowness in the direction of the piston shoe-pivot axis prevents any deformation of the piston shoe from said axis or from parallelity to said axis. The piston shoe becomes radially very strong and capable of withstanding very high fluid pressures.

The depressions 2 are parallel to the direction of movement of the outer face 32 of the piston shoe along the inner face 33 of piston stroke actuator 12. On the other hand the extension normal to the direction of said movement is very small. Thereby the sealing land around the depression 2 is equal in extension almost over the whole length sorrounding the depression. We obtain equal actions of lubrication almost over the whole extension of the sealing lands. The area of sealing land which is also adapted to movement parallel to the direction of movement of the piston shoe is reduced to a minimum. Thus, the entire sealing land is almost equally and perfectly lubricated.

The long extension of the depressions 2 parallel to the direction of movement of the piston shoe can be so long that the recesses 1 of the other figures of the invention can be omitted.

As in all figures of the invention, the two depressions 2 and the sealing lands therearound, constituted in this FIG. 18 by the guide extensions 6 are distanced from the axis 186 of the piston in order to provide space for the recesses 63 which are required for the entrance of the rotor's radial extensions 13 it the deep dive of the piston shoe into the rotor. The direction of movement of the piston shoe is indicated between FIGS. 18 and 19.

FIG. 21 shows a portion of the prior art labeled FIG. 15 in an enlarged scale. At said FIG. 15 the deformation of the piston shoe and the resulting opening of a gap for escape of leakage was illustrated. The prior art shown in FIG. 21 presented another difficulty. The circular configuration of the depression 62 resulted in unequal extensions 162 of the sealing land surrounding and sealing the depression 62. These unequal portions 162 of the sealing land are unsafe in the spirit of this invention and they are shown by the square form dotted line around depression 62. In these portions of the sealing land the lubrication is not assured since the fluid can enter only a very few mm into the small, narrow clearance between the faces 32 and 33. The whole areas 266 are alo unsafe zones in the spirit of this invention because fluid can not enter such extended narrow clearances. They are also unsuitably non-lubricated and suffer from friction.

FIG. 22 is a sectional view through FIG. 21 with the respective clearance between the faces 32 and 33 greatly enlarged. Out of depression 62 fluid moves between the faces 32 and 33 when the piston shoe moves upward in the drawing. Because the relative movement between faces 32 and 33 now tracts fluid out of the pocket 2 between the faces 32 and 33 in the area 266 by Newtons law of shear in fluid, the pressure in the pocket 2 plus the shear due to move between the neighboring faces 32 and 33 cause the fluid present in depression 2 to move into the clearance 266. On the other end the shear due to friction between the faces 32 and 33 acts in the direction towards the depression 2. Thus, here in the area 262 at top of FIGS. 21 and 22 therefore there is less fluid in the clearance than in the bottom of the said figures close to numeral 266. Consequently the fluid forces in the clearance tend to narrow the clearance at 366 and to cause friction or at 366 while the excessive fluid on the bottom of the figures tends to provide a gap 266 between the faces 32 and 33 wherethrough leakage can escape. Actually this action is somewhat limited by the long guide portions 6, but the trend is present and prevents a high increase in pressure and relative velocity between the faces. In FIG. 23 of the prior art, the described action and trend is even worse. Because here the depression 462 is perpendicular or normal to the direction of relative movement between the faces 32 and 33 very extensive friction areas 362 and leakage gaps 266 develop.

These troubles are overcome by the invention, because the depression is extended parallel to the movement and in the direction of movement of the piston shoe relative to the actuator means or piston stroke guide member 12. The sealing lands or seal faces on the left and right sides of the fluid pressure pockets or depressions 2 are extended equally on the respective side over the entire length of the depressions 2. The sealing land portions ahead of and behind the pockets 2 in the direction of movement of the piston shoe are very small and the actions described with respect to FIGS. 21 to 23 are therefore narrowed to a minimum and the respective portions of the sealing lands are narrowed to only a small fraction of the entire sealing lands.

The areas 162 of FIG. 21 appear in the novel piston shoe outer face of FIG. 18 too, but in a very much reduced degree, so that the possibility of insufficient lubrication in FIG. 18 is almost nil.

Further, in FIG. 18 the piston shoe can not deform, because as also seen from FIG. 20, the piston shoe remains in its extension parallel to the pivot axis 122 within the outer diameter of the piston 8 and the fluid force containing balancing pockets or depressions 2 remain mainly radially above the radially extended portion 22 of the piston shoe. This however is the portion of the piston shoe of most radial strength and bearing capability.

The fluid pressure pockets 2 and the sealing lands theraround constitute hydrostatic bearings and the sealing zones are therefore called sealing lands, while the fluid under pressure receiving and containing pockets 2 are also called depressions.

As seen in FIGS. 6 and 18, the sealing lands include portions of definite extension and configuration and thereby of definite measure of lubrication. They are areas of certainty in the spirit of this invention shown by numeral 100 in FIG. 18. The actuating body has an axis parallel to the axis of the central axis defining body or rotor 9. The axis of said actuating body or guide ring 33 is spaced from the axis of the central axis defining body 9. Thereby an eccentricity is provided between said bodies. The consequence of this eccentricity is that the contact faces of the piston shoes move relatively along the guide face of the actuating body. This actuating body 33 has parallel ends. The said contact faces 32 of the piston shoes 7 thus move along the guide face 33 in a direction of movement which is parallel to the ends of actuating body 12.

The portions 100 of the sealing lands thereby extend parallel to the ends of actuating body 12 and they are parallel portions.

The portions 100 are an important requirement for suitable and safe operation of the invention because the parallelity of these portions of the sealing land assures equal lubrication and equal zones of security over the entire extension of the said portion of the sealing land in the said direction of movement.

These parallel portions 100 are also a requirement for making the extension of the depressions 2 in the said direction of movement effective by sealing the entire extension of the respective depression in the direction of movement.

The pistons 8 carry the piston shoe pivot portions 22 pivotably in respective bearing beds in the outer ends of the pistons 8. The said pivot portions and bearing beds are so configured, that the piston shoes can pivot relative to the respective pistons to the required extent and that at same time the piston shoes radially bear on said bearing beds of the pistons.

It has been shown throughout the specification that the annular ring groove 19 of actuating body 12 separates the two sealing lands of each pair of hydrostatic bearings from each other. A study of FIGS. 18 and 20 will however show that the sealing lands of each pair of hydrostatic bearings can be separated from each other also by other recess means. In devices with very large piston strokes for example the medial portion above the pivot portion 22 of the piston shoe must be narrowed towards the upper radial end of the piston shoe in order to prevent touching of the respective portion of the respective cylinder wall, wherein the piston shoe operates together with the respective piston. The recesses 63 may then, as shown in the said figures, meet each other at a common recess 63 above the pivot portion 22. The sealing lands of both hydrostatic bearings are then completely separated from each other by the recess(es) 63.

With the above considerations of this invention in mind, it will now be possible to improve the contact face of the piston shoe of FIG. 13 or 14 so, that it can obtain the high efficiency of the piston shoes of this invention. For this purpose, the intersecting depressions or recesses 63 are provided between the outer portions 4 and 5 of the outer axial ends of the piston shoe contact face. They extend from the recess 84 of FIGS. 13,14,16,17 to the circumferential end of the contact face, as shown in FIGS. 16 and 17. By these depressions or recesses 63 the end portions of the contact face are separated from each other and thereby they are axially shortened. This shortening prevents the building up of too strong hydrodynamic bearing forces between the contact face and the guide face or control face of the actuator body because the fluid between the said faces can now easily escape axially away from the area between the said faces. For further improvement the recesses 3 of FIGS. 5,6 can be applied to and provided in the contact face of FIGS. 16 and 17. They then serve the same purpose, as in FIGS. 5 and 6. If the piston shoe of FIGS. 16 and 17 is a very large dimensioned one, then it is suitable and of help, to provide additionally the interruption recesses 86 in the end portions of the contact face. Thereby the axial extension of the contact face portions is again narrowed, whereby the outflow of fluid between the contact face and the guide face of the actuator 12 is speeded up. With above described provisions the piston shoe of the prior art is so improved, that it now can operate as suitable and with about the same efficiency as the piston shoe of FIGS. 3 to 6 of the invention, as far as the efficiency of its contact face is concerned. Since the recess 63 extends only radially into the piston shoe, but not through it, the piston shoe of FIGS. 16 and 17 can not obtain the same high piston stroke and flow through capacity as that of FIGS. 3 to 6. Insofar the overall performance of the shoe of FIGS. 16 and 17 remains below that of FIGS. 3 to 6.

In FIGS. 1 and 2 the actuator means or actuator body 12 radially sorrounds the rotor 9. The construction can however be also reserved, so that the actuator means or body 12 is inwardly of a hollow cylinders containing body 9. The cylinders containing body 9 then radially surrounds the actuator body 12. The center of the radius of the contact face of the piston shoe is then radially oppositely located. The rotor 9 must not be in all applications a rotor. Because the body 9 can also be stationary with the guide faces 33 of the actuator and the actuator body 12 revolving eccentrically, the body 9 is therefore referred to in the claims alternately as "a rotor" and "a cylinders containing body".

It will be understood that each of the elements described above, or two or more together, may also find a useful application in other types of contructions differing from the types described above.

While the invention has been illustrated and described as embodied in a piston shoe for a radial piston machine, it is not intended to be limited to the details shown since various modifications and structural changes may be made without departing in any way from the spirit of the present invention.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A radial piston machine comprising;

a central axis defining body able to revolve around said central axis and having a plurality of pistons reciprocable in radially open cylinders; a piston stroke actuating body radially of said central body and having an annular guide face turned toward said central body; each one piston radially reciprocal in each of said cylinders and having an outer end turned toward said guide face;

said outer ends forming bearing beds for the pivotable reception of a pivot portion of a respective piston shoe; each one piston shoe associated with each one of said pistons having a pivot portion carried and borne on the said bearing bed of the respective piston;

said piston shoes having guide portions extending peripherally relatively to said actuating body in the direction of rotation of said central body and having contact faces riding on said guide face;

each of said piston shoes being formed with a pair of fluid pressure receiving and containing depressions and sealing lands around said depressions whereby said sealing lands and depressions form together hydrostatic bearings;

said central body and said actuating body having medial axis; said axes being distanced from each other and forming an eccentricity between said bodies; said actuating body having axial ends and said piston shoes having axial ends parallel to said ends of said actuating body; said contact faces moving relatively to said guide face in a direction of movement parallel to said ends due to the said eccentricity between said bodies when at least said central axis defining body revolves; said depressions of said hydrostatic bearings closed by said guide face and by said sealing lands;

at least one recess provided in said machine and extended to said contact faces of said piston shoes for the separation of one of said hydrostatic bearings of a respective piston shoe from the other of said hydrostatic bearings of the respective piston shoe;

said recess extending parallel to said ends of said actuating body and of said piston shoes;

said depressions of each pair of said depressions laterally distanced from each other, parallel to each other, located in said guide portions and distanced from the axis of the respective piston;

said depressions extending in said direction of movement of said contact faces and being narrower in the direction parallel to said axes; said sealing lands including parallel portions with parallel ends in said direction of movement;

and portions of said hydrostatic bearings being located radially of said pistons and of said pivot portions.

2. The machine of claim 1, wherein two parallel portions of said sealing lands are separated from each other by a recess means between said guide portions.

3. The machine of claim 2, wherein said parallel portions include innermost portions and outermost portions and wherein said innermost portions are narrower than said outermost portions.

4. The machine of claim 1, wherein said guide portions extend in said direction of movement beyond said sealing lands and form outer guide portions on the ends of said guide portions including outer guide face portions and including separation depressions for the separation of said outer guide face portions from said sealing lands.

5. The machine of claim 1, wherein at least two passage portions are provided to communicate said depressions of said hydrostatic bearings through the respective piston and piston shoe of said pistons to the respective cylinder associated therewith.

6. The machine of claim 2, wherein said recess means is an annular ring groove provided in said actuating body through said guide face of said actuating body.

7. The machine of claim 2, wherein said recess means is provided by a recess between said guide portions.

8. The machine of claim 1, wherein slots are provided in the direction of movement on both ends of a medial portion of each piston shoe and between portions of said guide portions of said piston shoes.

* * * * *